US008989393B2

(12) United States Patent
Kishi et al.

(10) Patent No.: US 8,989,393 B2
(45) Date of Patent: Mar. 24, 2015

(54) DECODING DEVICE AND DECODING METHOD

(71) Applicant: Fujitsu Limited, Kawasaki (JP)

(72) Inventors: Yohei Kishi, Kawasaki (JP); Miyuki Shirakawa, Fukuoka (JP); Shunsuke Takeuchi, Kawasaki (JP); Masanao Suzuki, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 365 days.

(21) Appl. No.: 13/669,590

(22) Filed: Nov. 6, 2012

(65) Prior Publication Data

US 2013/0156200 A1 Jun. 20, 2013

(30) Foreign Application Priority Data

Dec. 14, 2011 (JP) ..... 2011-273804

(51) Int. Cl.
*H04R 5/00* (2006.01)
*G10L 19/008* (2013.01)

(52) U.S. Cl.
CPC ..... *G10L 19/008* (2013.01); *H04S 2420/03* (2013.01)
USPC ..... 381/17

(58) Field of Classification Search
CPC ..... G10L 19/008; H04S 2420/03
USPC ..... 381/17
See application file for complete search history.

(56) References Cited

U.S. PATENT DOCUMENTS

2011/0046946 A1* 2/2011 Liu et al. ..... 704/203

OTHER PUBLICATIONS

Information technology—MPEG audio technologies—Part 1: MPEG Surround, ISO/IEC 23003-1, Feb. 15, 2007, pp. I-VI, pp. 20-56, pp. 125-126, pp. 250-260.
ISO/IEC 14496-3:2005 (E), 2005, pp. 1-344.
International Organisation for standardization, ISO/IEC JTC1/SC29/WG11, Coding of Moving Pictures and Audio, ISO/IEC 13818-7, 2005, pp. I-VI, pp. 7-181.

* cited by examiner

*Primary Examiner* — Duc Nguyen
*Assistant Examiner* — Kile Blair
(74) *Attorney, Agent, or Firm* — Staas & Halsey LLP

(57) ABSTRACT

A decoding device includes a decoder configured to separate a first signal obtained by performing down-mix on original signals of a plurality of channels, a residual signal representing a component of a difference between the original signals and the first signal, and spatial information representing the relationship among the original signals of the plurality of channels from an input signal which is obtained by multiplexing the first signal, the residual signal, and the spatial information and decode the separated encoded first signal, the encoded residual signal, and the encoded spatial information; a decorrelation signal generation unit configured to generate a decorrelation signal as decorrelation of the first signal decoded by the decoder; a residual signal determination unit configured to determine whether a level of the residual signal decoded by the decoder is equal to or smaller than a predetermined residual threshold value; a second-signal generation unit.

16 Claims, 22 Drawing Sheets

FIG. 5

| | | | | | | | | | | | |
|---|---|---|---|---|---|---|---|---|---|---|---|
| idx | -15 | -14 | -13 | -12 | -11 | -10 | -9 | -8 | -7 | -6 | -5 |
| CLD (idx) | -150 | -45 | -40 | -35 | -30 | -25 | -22 | -19 | -16 | -13 | -10 |
| idx | -4 | -3 | -2 | -1 | 0 | 1 | 2 | 3 | 4 | 5 | 6 |
| CLD (idx) | -8 | -6 | -4 | -2 | 0 | 2 | 4 | 6 | 8 | 10 | 13 |
| idx | 7 | 8 | 9 | 10 | 11 | 12 | 13 | 14 | 15 | | |
| CLD (idx) | 16 | 19 | 22 | 25 | 30 | 35 | 40 | 45 | 150 | | |

FIG. 6

| idx | 0 | 1 | 2 | 3 | 4 | 5 | 6 | 7 |
|---|---|---|---|---|---|---|---|---|
| ICC (idx) | 1 | 0.937 | 0.84118 | 0.60092 | 0.36764 | 0 | -0.589 | -0.99 |

DECODING DEVICE AND DECODING METHOD

CROSS-REFERENCE TO RELATED APPLICATION(S)

This application is based upon and claims the benefit of priority of the prior Japanese Patent Application No. 2011-273804, filed on Dec. 14, 2011, the entire contents of which are incorporated herein by reference.

FIELD

The embodiments discussed herein are related to a decoding device, a decoding method, and a computer readable recording medium which stores a decoding program.

BACKGROUND

In general, a decoding method for obtaining original signals of a plurality of channels by decoding an input signal obtained by converting the original signals of the plurality of channels into a down-mix main signal, a residual signal, and spatial information and encoding the main signal, the residual signal, and the spatial information has been used.

For example, as a method for encoding surround audio signals of 5.1 ch, an MPEG surround method standardized by ISO/IEC (ISO/IEC 23003-1) has been used. In the MPEG surround method, a surround audio signal is converted into a single-channel or two-channel down-mix signal (main signal), a residual signal, and spatial information and the main signal, the residual signal, and the spatial information are encoded. An MPEG surround decoder obtains surround audio signals by decoding the down-mix signal, the residual signal, and the spatial information.

In such a general decoding method using a main signal, a residual signal, and spatial information, when an input signal is decoded, the residual signal is used in a frequency band determined in advance at a time of encoding and a decorrelation signal generated from the decoded main signal is used instead of the residual signal in other frequency bands.

SUMMARY

In accordance with an aspect of the embodiments, a decoding device includes a decoder configured to separate a first signal obtained by performing down-mix on original signals of a plurality of channels, a residual signal representing a component of a difference between the original signals and the first signal, and spatial information representing the relationship among the original signals of the plurality of channels from an input signal which is obtained by multiplexing the first signal, the residual signal, and the spatial information and decode the separated encoded first signal, the encoded residual signal, and the encoded spatial information; a decorrelation signal generation unit configured to generate a decorrelation signal as decorrelation of the first signal decoded by the decoder; a residual signal determination unit configured to determine whether a level of the residual signal decoded by the decoder is equal to or smaller than a predetermined residual threshold value; a second-signal generation unit configured to generate a second signal corresponding to the decoded residual signal when the residual signal determination unit determines that the level of the residual signal is larger than the residual threshold value whereas generate a second signal by replacing the decoded residual signal by the decorrelation signal generated by the decorrelation signal generation unit when the residual signal determination unit determines that the level of the residual signal is equal to or smaller than the residual threshold value; and an output signal generation unit configured to generate an output signal by decoding the input signal in accordance with the first signal decoded by the decoder, the second signal generated by the second signal generation unit, and the spatial information decoded by the decoder.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 5 is a diagram schematically illustrating a CLD parameter table;

FIG. 6 is a diagram schematically illustrating an ICC parameter table;

DESCRIPTION OF EMBODIMENTS

Hereinafter, embodiments of the disclosed technique will be described in detail with reference to the accompanying drawings. In the embodiments, a decoding device which decodes an input signal which has been encoded in an MPEG surround method will be described.

Figure 1:
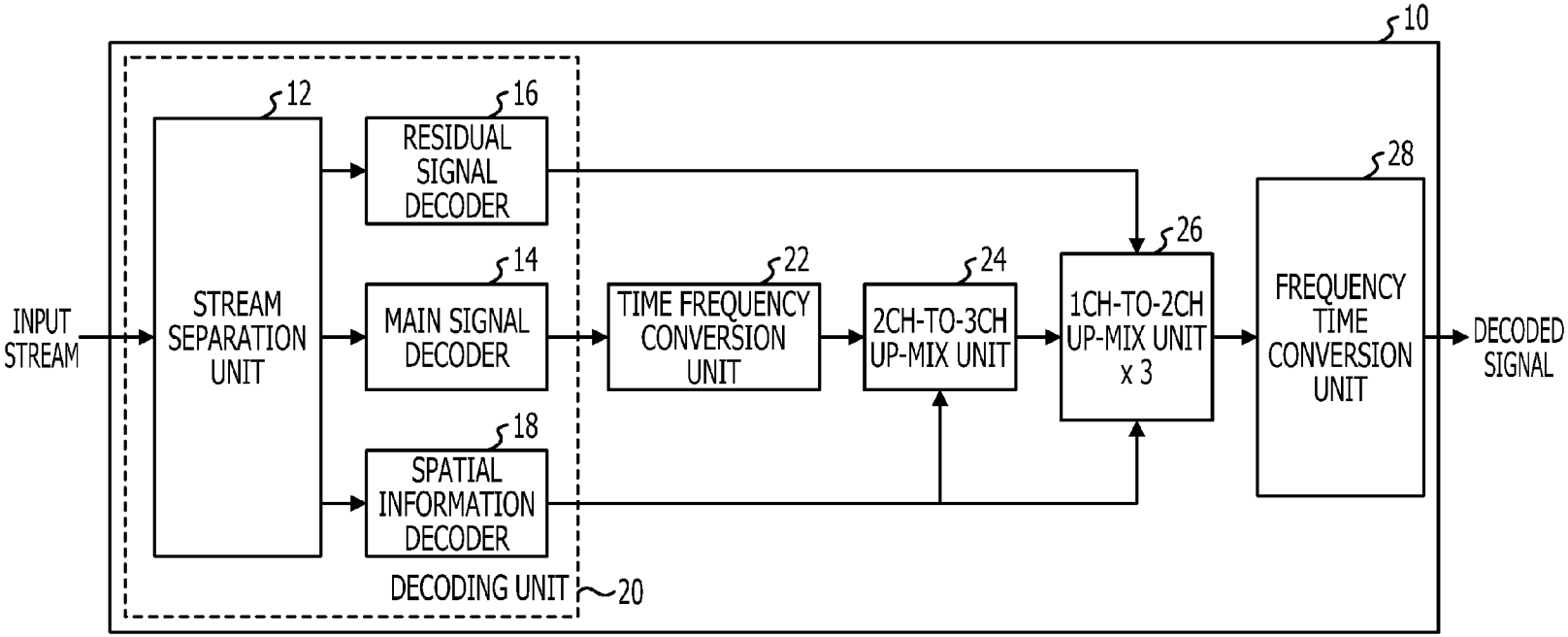
FIG. 1 is a functional block diagram illustrating a decoding device according to a first embodiment.

FIG. 1 is a diagram illustrating a decoding device 10 according to a first embodiment. The decoding device 10 performs a process of decoding an input stream and outputting a decoded signal. The decoding device 10 includes a decoding unit 20, a time-frequency conversion unit 22, a first up-mix unit 24, a second up-mix unit 26, and a frequency-time conversion unit 28. Hereinafter, a 2ch-to-3ch up-mix unit 24 which performs up-mix from two channels to three channels will be described as the first up-mix unit 24 as an example. Furthermore, the second up-mix unit 26 further performs up-mix on a signal which has been subjected to the up-mix performed by the first up-mix unit 24. Hereinafter, three 1ch-to-2ch up-mix units 26 which perform up-mix so that the number of channels of each channel signal output from the 2ch-to-3ch up-mix unit 24 is changed from one to two will be described as the second up-mix units 26 as examples.

Figure 2:
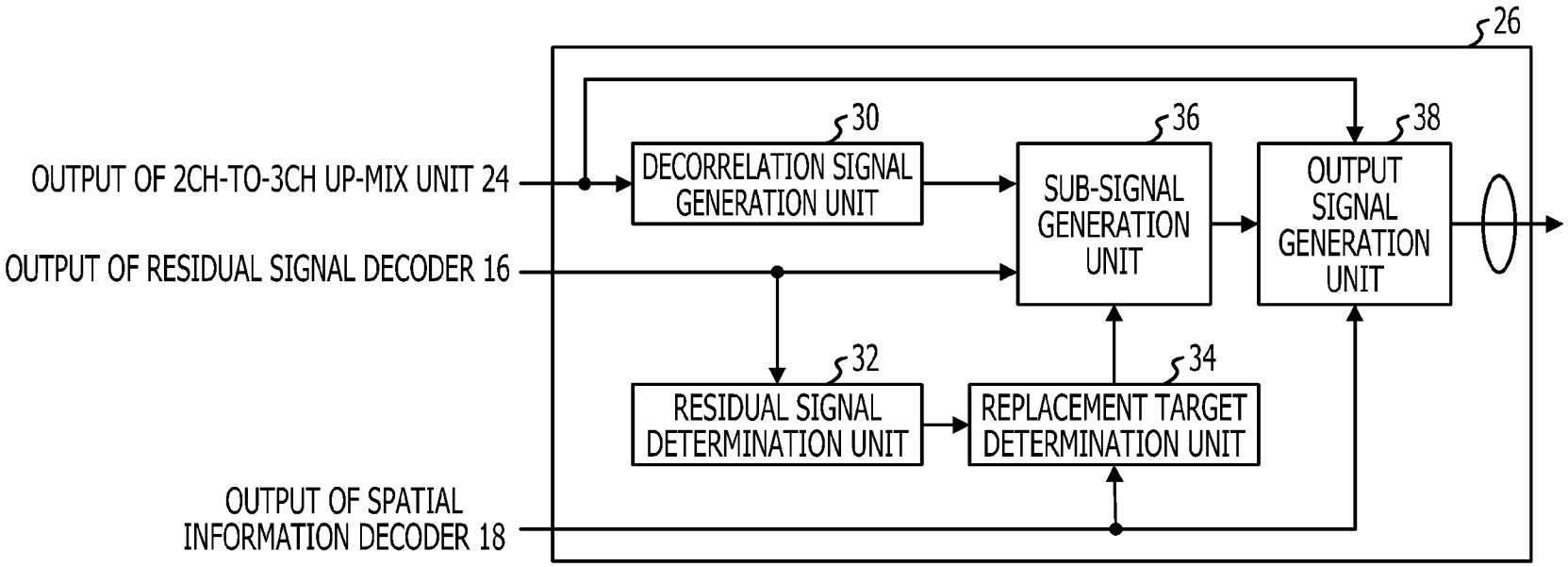
FIG. 2 is a functional block diagram illustrating an 1ch-to-2ch up-mix unit according to the first embodiment.

The decoding unit 20 further includes a stream separation unit 12, a main signal decoder 14, a residual signal decoder 16, and a spatial information decoder 18. Furthermore, each of the 1ch-to-2ch up-mix units 26 includes, as illustrated in FIG. 2, a decorrelation signal generation unit 30, a residual signal determination unit 32, a replacement target determination unit 34, a sub-signal generation unit 36, and an output signal generation unit 38.

Figure 3:
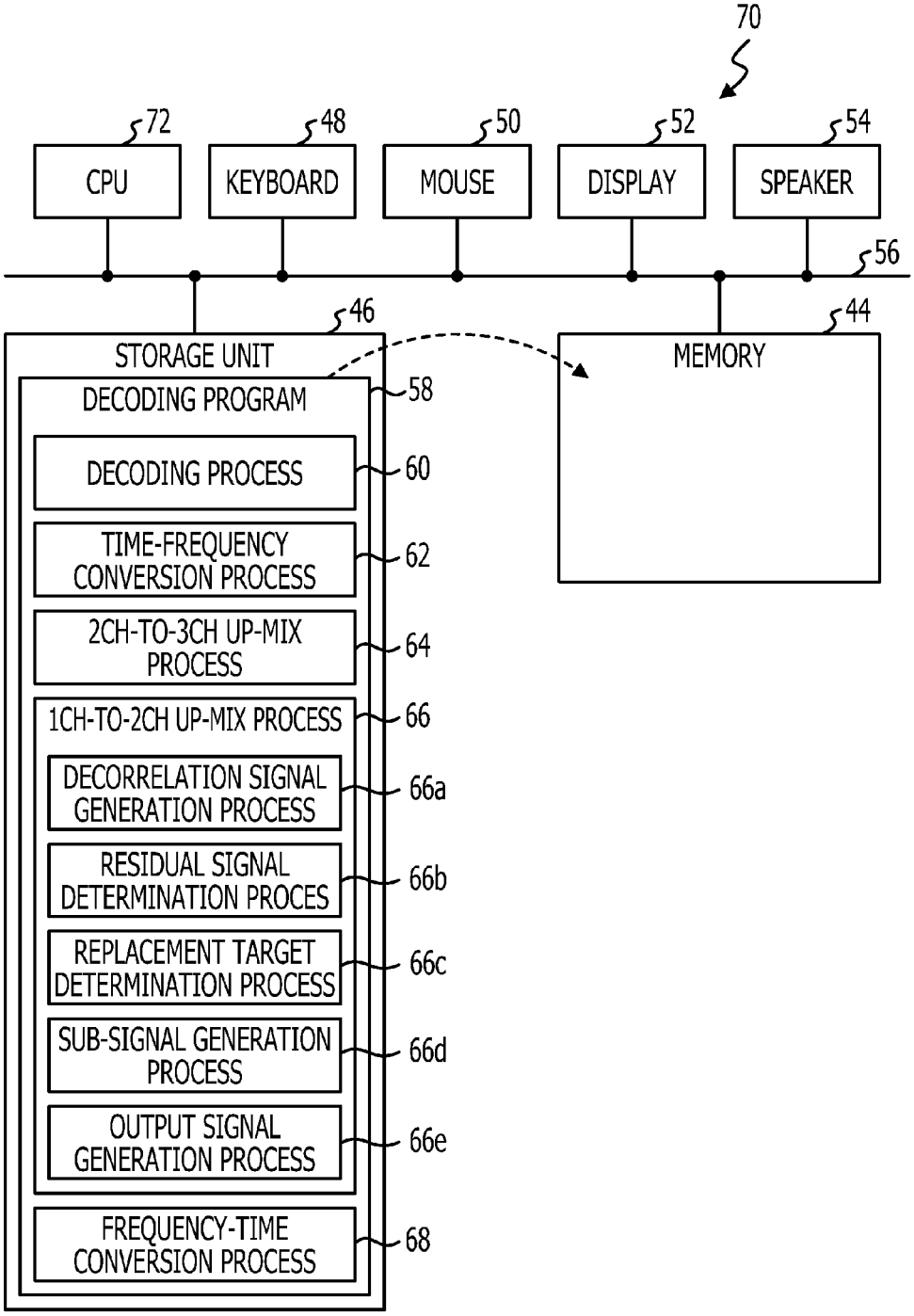
FIG. 3 is a block diagram schematically illustrating a computer functioning as a decoding device.

The decoding device 10 may be realized by a computer 70 illustrated in FIG. 3, for example. The computer 70 includes a CPU 72, a memory 44, a nonvolatile storage unit 46, a keyboard 48, a mouse 50, a display 52, and a speaker 54 which are connected to one another through a bus 56. Note that the storage unit 46 is realized by an HDD (Hard Disk Drive), a flash memory, or the like. The storage unit 46 serving as a recording medium stores a decoding program 58 which causes the computer 70 to function as the decoding device 10. The CPU 72 reads the decoding program 58 from the storage unit 46 and develops the decoding program 58 in the memory 44 so as to successively execute processes included in the decoding program 58.

The decoding program 58 includes a decoding process 60, a time-frequency conversion process 62, a 2ch-to-3ch up-mix process 64, an 1ch-to-2ch up-mix process 66, and a frequency-time conversion process 68. Furthermore, the 1ch-to-2ch up-mix process 66 includes a decorrelation signal generation process 66*a*, a residual signal determination process 66*b*, a replacement target determination process 66*c*, a sub-signal generation process 66*d*, and an output signal generation process 66*e*. The CPU 72 executes the decoding process 60 so as to function as the decoding unit 20 illustrated in FIG. 1. Furthermore, the CPU 72 executes the frequency-time conversion process 68 so as to function as the time-frequency conversion unit 22 illustrated in FIG. 1. The CPU 72 executes the 2ch-to-3ch up-mix process 64 so as to function as the 2ch-to-3ch up-mix unit 24 illustrated in FIG. 1. The CPU 72 executes the 1ch-to-2ch up-mix process 66 so as to function as the 1ch-to-2ch up-mix units 26 illustrated in FIG. 1. The CPU 72 executes the frequency-time conversion process 68 so as to function as the frequency-time conversion unit 28 illustrated in FIG. 1. The CPU 72 executes the decorrelation signal generation process 66*a* so as to function as the decorrelation signal generation unit 30 illustrated in FIG. 2. The CPU 72 executes the residual signal determination process 66*b* so as to function as the residual signal determination unit 32 illustrated in FIG. 2. The CPU 72 executes the replacement target determination process 66*c* so as to function as the replacement target determination unit 34 illustrated in FIG. 2. The CPU 72 executes the sub-signal generation process 66*d* so as to function as the sub-signal generation unit 36 illustrated in FIG. 2. The CPU 72 executes the output signal generation process 66*e* so as to function as the output signal generation unit 38 illustrated in FIG. 2. In this way, the computer 70 which executes the decoding program 58 functions as the decoding device 10.

Note that the decoding device 10 may be realized by a semiconductor integrated circuit, for example, or more specifically, an ASIC (Application Specific Integrated Circuit) or the like, for example.

Figure 4:
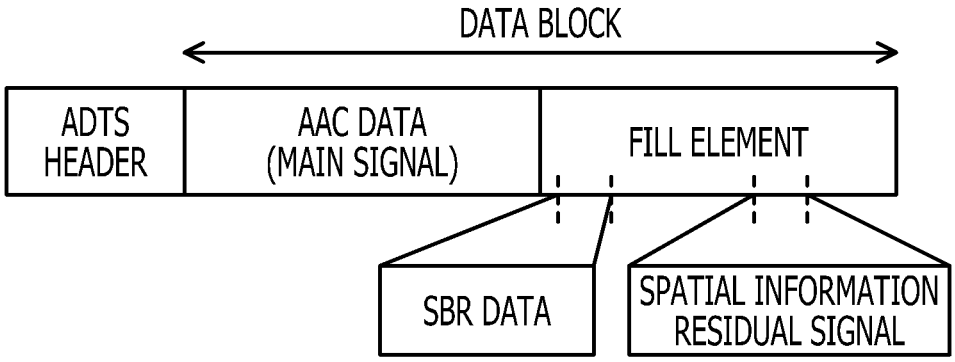
FIG. 4 is a diagram schematically illustrating a format of an input stream.

The stream separation unit 12 analyzes an input stream which is an input signal which is input in a time-series manner with a predetermined interval and divides the multiplexed input stream. Here, the input stream is obtained by encoding and multiplexing a main signal obtained by performing down-mix on original signals of a plurality of channels, a residual signal representing a difference component generated when the original signals are subjected to the down-mix, and spatial information representing the relationship among the original signals of the plurality of channels. FIG. 4 is a diagram illustrating a format of the input stream in the MPEG surround. The format illustrated in FIG. 4 includes various fields corresponding to an ADTS (Audio Data Transport Stream) header, MC (Advanced Audio Coding) data, and a fill element in a header format referred to as an "ADTS header format". The MC data corresponds to the main signal, and the fill element includes the residual signal and the spatial information. Note that the fill element further includes SBR (Spectral Band Replication) data which is used in the main signal decoder 14 which will be described hereinafter. The encoded main signal, the encoded residual signal, and the encoded spatial information are separated from the input stream obtained by multiplexing the various signals as described above. Note that the method disclosed in the ISO/IEC14496-3 standard may be used as a separation method.

The main signal decoder 14 decodes the encoded main signal which has been separated by the stream separation unit 12 by a decoding method corresponding to an encoding method. In the MPEG surround method, the main signal is decoded by an HE-MC (High-Efficiency Advanced Audio Coding) method using the SBR data. By the decoding performed in accordance with the HE-MC method, main signals x1 and x2 of two channels are obtained. Note that, for the decoding performed in accordance with the HE-MC method, a method disclosed in the ISO/IEC 14496-3 standard may be employed. Note that methods other than the HE-ACC method may be employed as the method for decoding the main signal. In this case, the configuration of the stream separation unit 12 and the main signal decoder 14 may be changed in accordance with an employed decoding method.

The residual signal decoder 16 decodes the encoded residual signal which has been separated by the stream separation unit 12 by a decoding method corresponding to an encoding method. For example, when the residual signal is encoded by the MC method, the residual signal is decoded by the MC method. Note that, for the decoding performed in accordance with the MC method, a method disclosed in the ISO/IEC 13818-7 standard may be employed. Hereinafter, the decoded residual signal is referred to as a "residual signal Res".

The spatial information decoder 18 decodes the encoded spatial information which has been separated by the stream separation unit 12 with reference to a quantization table used in encoding. The relationship among the original signals of the plurality of channels represented by the spatial information includes CLD (Channel Level Differences) representing differences among powers of the signals and ICC (Inter channel Correlation/Coherences) representing similarity among the signals. The encoded CLD is decoded with reference to a CLD parameter table illustrated in FIG. 5, for example. Similarly, the encoded ICC is decoded with reference to an ICC parameter table illustrated in FIG. 6, for example.

Figure 7:
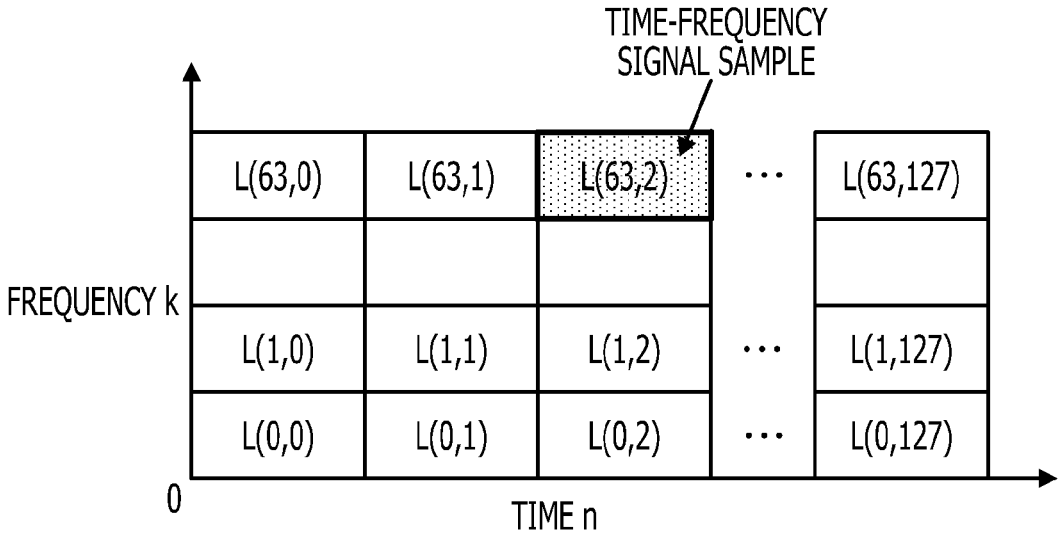
FIG. 7 is a diagram schematically illustrating a main signal which has been subjected to time-frequency conversion.

The time-frequency conversion unit 22 converts the main signals x1 and x2 which are time signals decoded by the main signal decoder 14 into frequency signals. Specifically, the time-frequency conversion unit 22 converts the main signals x1 and x2 represented by time signals L[n] into frequency signals L[k][n] using a complex QMF (Quadrature Mirror Filter) bank as illustrated in Expression (1) below. Note that "n" denotes time and "k" denotes a frequency band. The main signals which have been subjected to the time-frequency conversion by the QMF are illustrated in FIG. 7. In FIG. 7, "L(k, n)" represents signal samples.

$$QMF(k,n) = \exp\left[j\frac{\pi}{128}(k+0.5)(2n+1)\right], \quad 0 \le k < 64,\ 0 \le n < 128 \tag{1}$$

Figure 8:
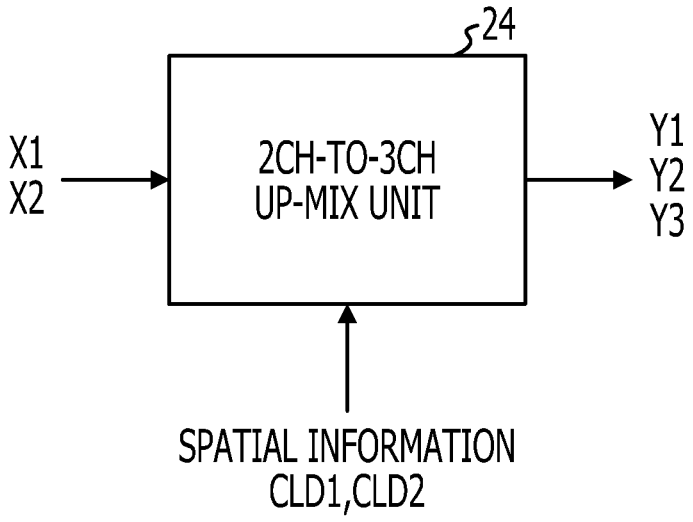
FIG. 8 is a functional block diagram illustrating a 2ch-to-3ch up-mix unit.

The 2ch-to-3ch up-mix unit 24 performs up-mix on the main signals which have been converted into the frequency signals by the time-frequency conversion unit 22. Here, the 2ch-to-3ch up-mix unit 24 performs up-mix on main signals X1 and X2 of two channels obtained by converting the above-described main signals x1 and x2 into time frequency signals so as to output main signals Y1, Y2, and Y3 of three channels which have been subjected to the up-mix. FIG. 8 is a functional block diagram illustrating the 2ch-to-3ch up-mix unit 24. The 2ch-to-3ch up-mix unit 24 performs up-mix calculation in accordance with Expression (2) below, for example.

$$\begin{bmatrix} Y1 \\ Y2 \\ Y3 \end{bmatrix} = \begin{bmatrix} w_{11} & 0 \\ 0 & w_{22} \\ w_{31}\sqrt{2} & w_{32}\sqrt{2} \end{bmatrix} \begin{bmatrix} X1 \\ X2 \end{bmatrix} \tag{2}$$

Here, "w" represents a value illustrated in Expressions (3) and (4) below. Note that "$CLD_1$" and "$CLD_2$" included in Expression (4) are information obtained from the spatial information decoded by the spatial information decoder 18.

$$w_{11} = \sqrt{\frac{q_1 q_2}{q_2 + 1 + q_1 q_2}},\ w_{22} = \sqrt{\frac{q_1}{q_1 + q_2 + 1}},$$
$$w_{31} = \frac{1}{2}\sqrt{\frac{q_2 + 1}{q_2 + 1 + q_1 q_2}},\ w_{32} = \frac{1}{2}\sqrt{\frac{q_2 + 1}{q_1 + q_2 + 1}} \tag{3}$$

-continued $$q_1 = 10^{\frac{CLD_1}{10}},\ q2 = 10^{\frac{CLD_2}{10}} \tag{4}$$

Hereinafter, a main signal obtained by the up-mix performed by the 2ch-to-3ch up-mix unit 24 is described as a "main signal In".

Figure 9:
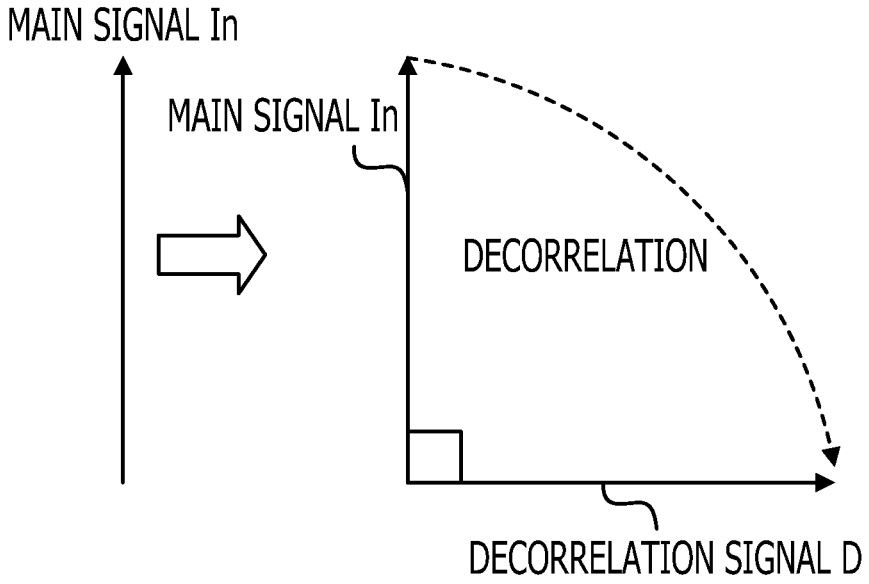
FIG. 9 is a diagram schematically illustrating generation of a decorrelation signal.

The decorrelation signal generation unit 30 generates a decorrelation signal D as decorrelation of the main signal In. FIG. 9 is a diagram illustrating the relationship between the main signal In and the decorrelation signal D. As illustrated in FIG. 9, a phase of the main signal In and a phase of the decorrelation signal D are different from each other by 90 degrees.

Figure 10:
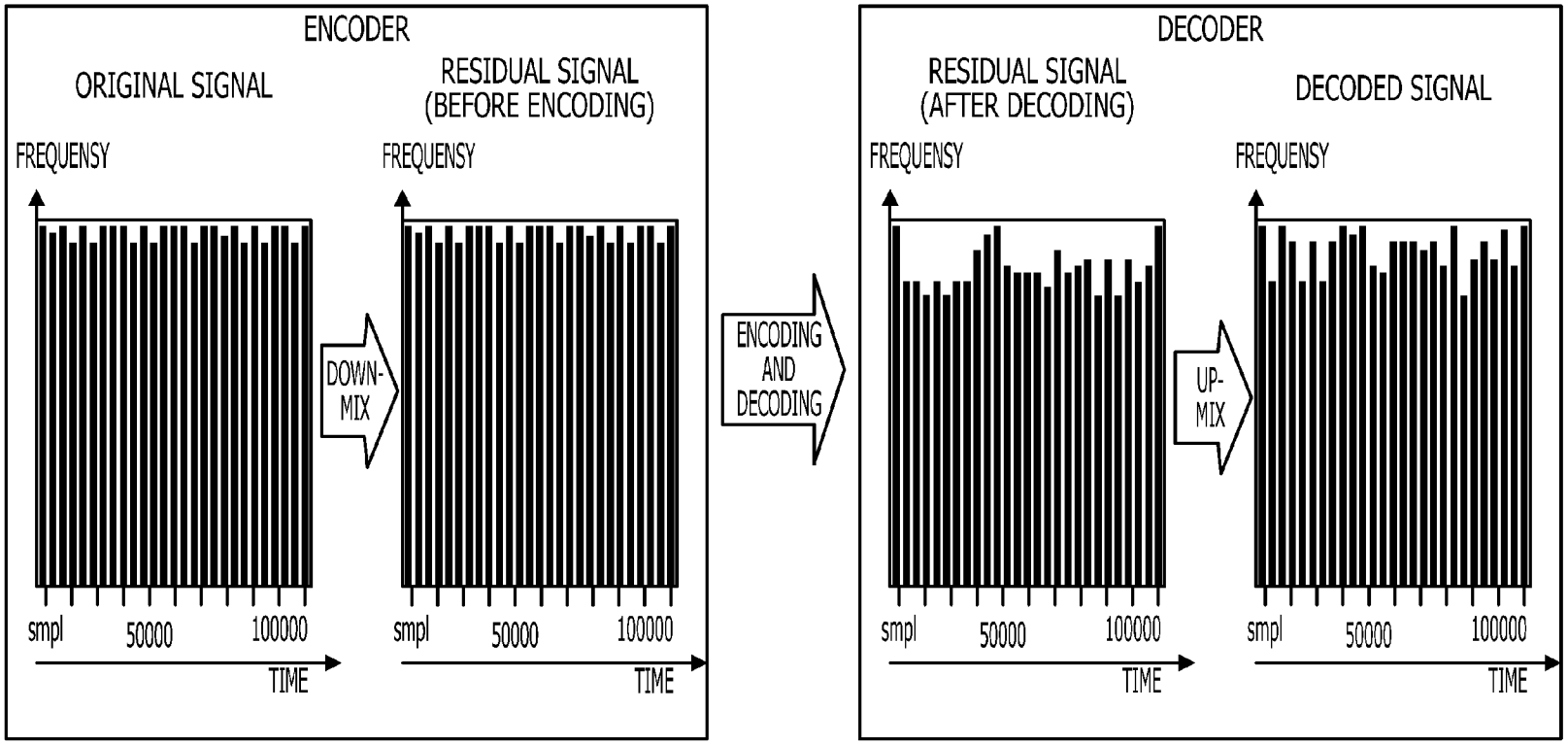
FIG. 10 is a diagram of spectra illustrating a lack portion of a residual signal.
Figure 11:
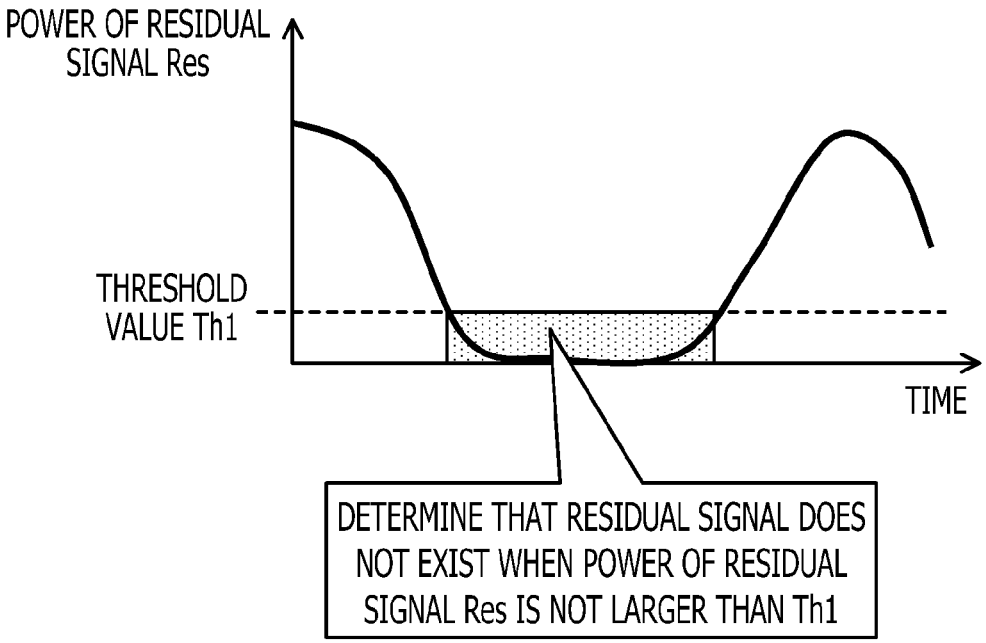
FIG. 11 is a diagram schematically illustrating presence or absence of a residual signal.

The residual signal determination unit 32 determines whether the residual signal Res includes a lack portion. It is possible that information on the residual signal is reduced due to the quantization at the time of encoding, and therefore, it is not necessarily the case that the restored residual signal includes all the information, that is, the residual signal includes a lack portion. FIG. 10 is a diagram illustrating spectra of an original signal, a residual signal (before encoding), a residual signal (after decoding), and a decoded signal. In FIG. 10, a portion (which is surrounded by an oval) in an upper portion of a band of the residual signal (after decoding) which is darker than a corresponding portion of the residual signal (before encoding) represents a lack portion of the residual signal. In the general techniques, in a case where the lack portion of the residual signal has been generated as described above in a frequency band where the residual signal is used when the residual signal or the decorrelation signal is selected depending on the frequency band, output signals are generated only by the main signals, and therefore, the output signals may be degraded. For example, in the example of FIG. 10, a portion (surrounded by the oval) which is darker than the corresponding portion of the original signal is included in a band of the decoded signal which corresponds to a band of the lack portion of the residual signal (after decoding), and it is apparent that the decoded signal is degraded. To replace the residual signal having the lack portion by the decorrelation signal generated by the decorrelation signal generation unit 30, the residual signal determination unit 32 determines whether the residual signal Res has a lack portion. Specifically, as illustrated in FIG. 11, when a power of the residual signal Res is equal to or smaller than a predetermined threshold value Th1, it is determined that the residual signal Res does not exist, that is, the residual signal Res lacks. The threshold value Th1 is preferably a value approximately $5\times10^9$.

Figure 12A:
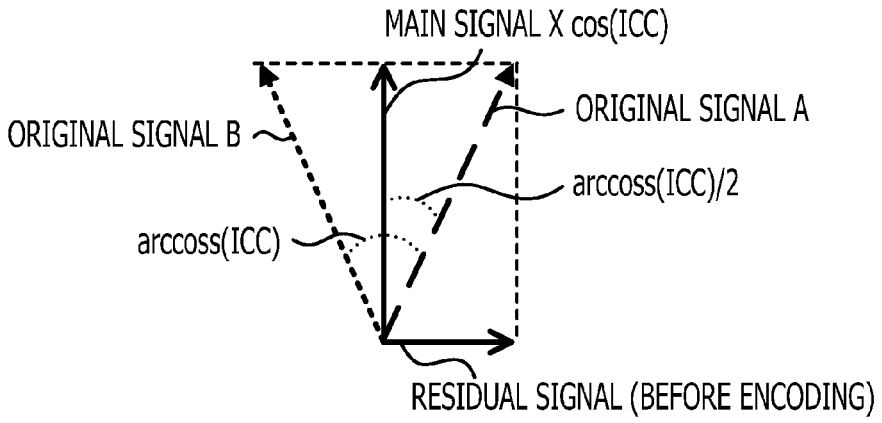
FIGS. 12A to 12C are diagrams of vectors schematically illustrating the relationships between a residual signal before encoding and an ICC.
Figure 12B:
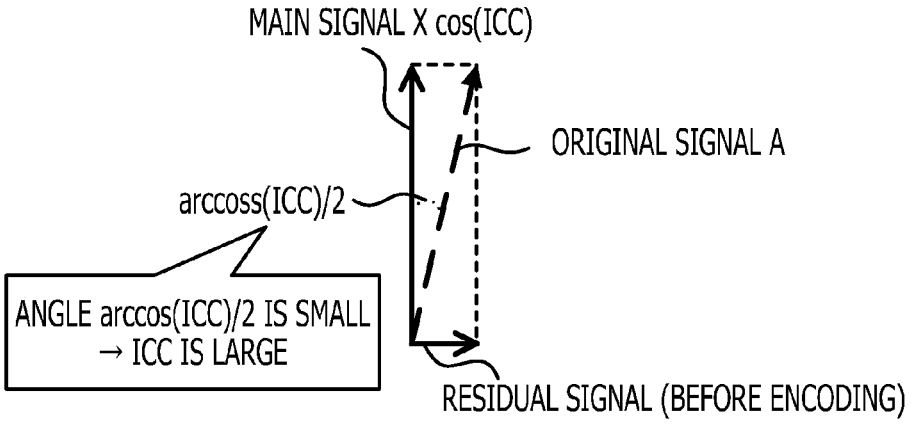
Figure 12C:
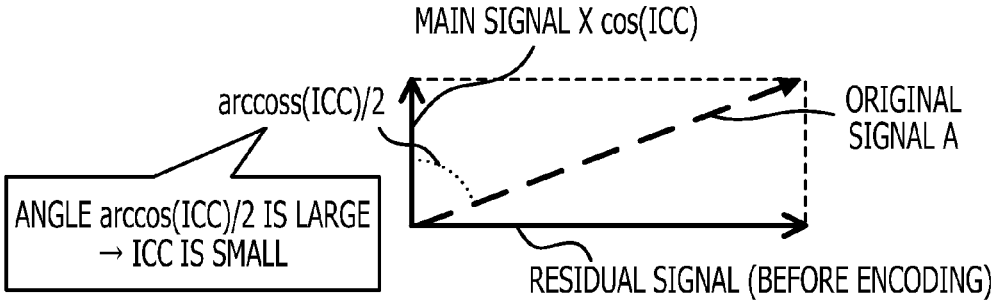

The replacement target determination unit 34 estimates whether the residual signal before encoding is large or small in the portion of the signal which is determined that the residual signal Res is equal to or smaller than the threshold value Th1. When it is estimated that the residual signal before encoding is large, it is determined that the residual signal is to be replaced by the decorrelation signal. The estimation whether the residual signal before encoding is large or small is performed by the ICC decoded by the spatial information decoder 18. FIGS. 12A to 12C are diagrams of vectors schematically illustrating the relationship between the residual signal before encoding and the ICC. As illustrated in FIG. 12A, the similarity ICC between one of the original signals (original signal A) corresponding to a first channel and the other one of the original signals (original signal B) corresponding to a second channel is represented by an angle arccos(ICC) defined by a vector representing the original signal A and a vector representing the original signal B. Furthermore, an angle defined by a vector representing a main signal obtained by performing down-mix on the original signals A and B and the vector representing the original signal A (or the original signal B) is represented by an angle arcos (ICC)/2. Here, since the residual signal is a component of difference between the original signals and the main signal, it is estimated that a signal which becomes the original signal A (or the original signal B) when being added to a main signal x cos(ICC) is a residual signal before encoding. Accordingly, as illustrated in FIG. 12B, when the residual signal before encoding is small, the angle arccos(ICC)/2 is small, that is, the similarity ICC is large. On the other hand, as illustrated in FIG. 12C, when the residual signal before encoding is large, the angle arccos(ICC)/2 is large, that is, the similarity ICC is small.

Figure 13A:
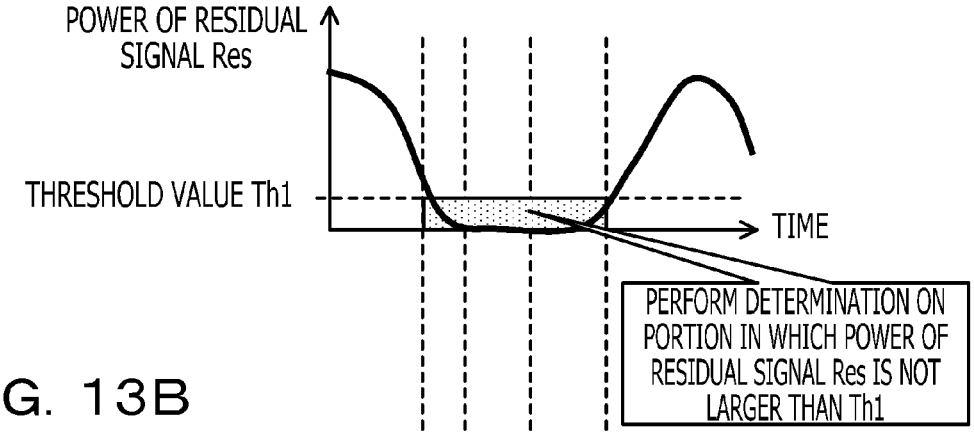
FIGS. 13A to 13C are diagrams schematically illustrating results of determinations made by a residual signal determination unit and a replacement-target determination unit and a final determination result.
Figure 13B:
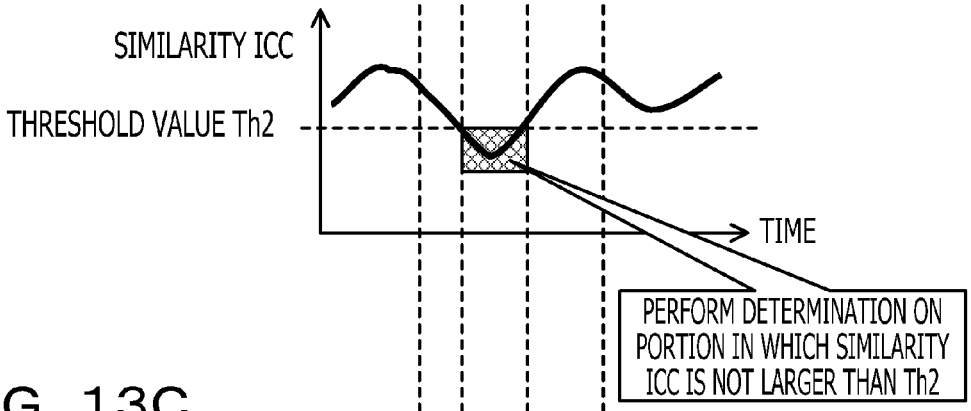
Figure 13C:
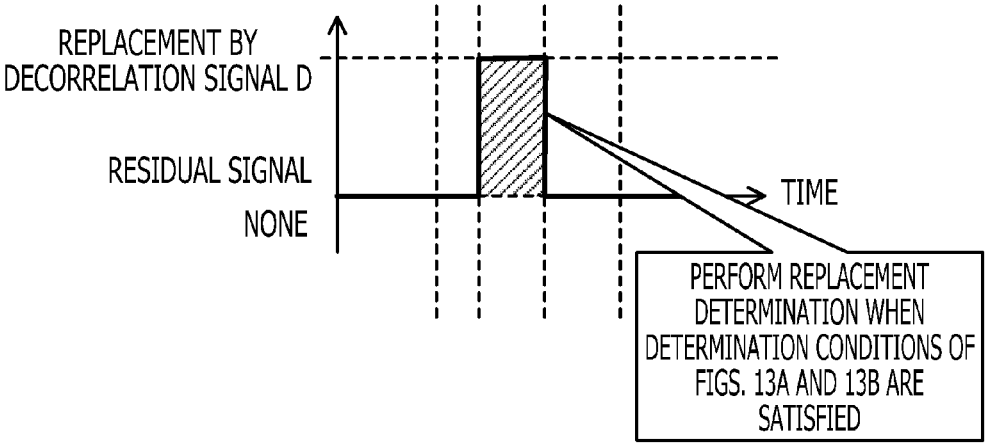

When the residual signal before encoding is large and the residual signal includes a lack portion after decoding, a deterioration degree is large when an output signal is generated. Therefore, the residual signal is preferably replaced by the decorrelation signal. On the other hand, when the residual signal before encoding is small, even if the residual signal includes a lack portion after decoding, influence on generation of an output signal is small. Since the decorrelation signal is generated from a decoded main signal, deterioration is suppressed when the residual signal having the lack portion is not replaced by a decorrelation signal when compared with a case where the residual signal having the lack portion is replaced by a decorrelation signal in some cases. Therefore, the replacement target determination unit 34 determines whether the lack portion of the residual signal Res is to be replaced by a decorrelation signal. Specifically, when the similarity ICC is equal to or smaller than a predetermined threshold value Th2, it is determined that replacement by a decorrelation signal is to be performed. The threshold value Th2 is preferably a value approximately 0.5. In FIG. 13, determination results of the residual signal determination unit 32 and the replacement target determination unit 34 and a result of a final determination as to whether the replacement by a decorrelation signal is to be performed are illustrated.

The sub-signal generation unit 36 generates a sub-signal Sub by replacing a portion of the residual signal Res finally determined to be replaced by a decorrelation signal in accordance with the determinations performed by the residual signal determination unit 32 and the replacement target determination unit 34 by a decorrelation signal D. The portion determined to be replaced by a decorrelation signal is replaced by the decorrelation signal D even if the portion is included in a band in which the residual signal is to be used.

Figure 14A:
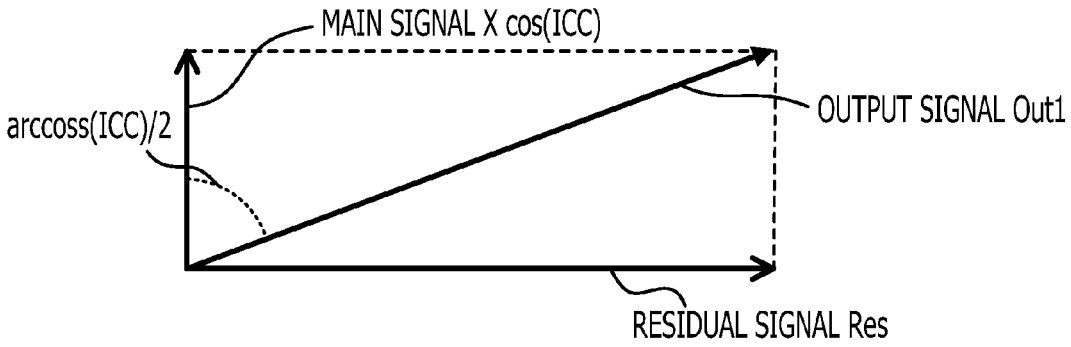
FIGS. 14A and 14B are diagrams of vectors schematically illustrating operations of an output signal generation unit.
Figure 14B:
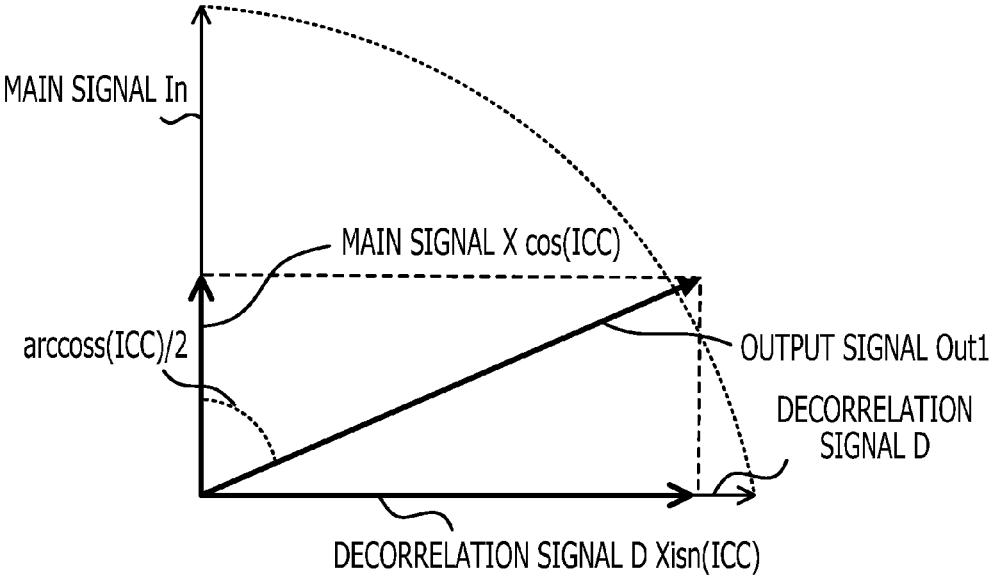

The output signal generation unit 38 generates output signals Out1 and Out2 of two channels using the main signal In, the sub-signal Sub output from the sub-signal generation units 36, and the spatial information. FIGS. 14A and 14B are diagrams of vectors schematically illustrating operations of the output signal generation unit 38. Specifically, the output signals Out1 and Out2 are calculated in accordance with Expression (5) below.

$$\begin{bmatrix} \mathrm{Out1} \\ \mathrm{Out2} \end{bmatrix} = \begin{bmatrix} H11 & H12 \\ H21 & H22 \end{bmatrix} \begin{bmatrix} \mathrm{In} \\ Sub \end{bmatrix} \tag{5}$$

In Expression (5), "H11", "H12", "H21", and "H22" are represented by Expression (6) below depending on whether the sub-signals Sub corresponds to the residual signal Res or the decorrelation signal D.

$$\begin{bmatrix} H11 & H12 \\ H21 & H22 \end{bmatrix} = \begin{cases} \begin{bmatrix} c_1\cos(\alpha+\beta) & 1 \\ c_2\cos(-\alpha+\beta) & -1 \end{bmatrix} & (Sub = Res) \\ \begin{bmatrix} c_1\cos(\alpha+\beta) & c_1\sin(\alpha+\beta) \\ c_2\cos(-\alpha+\beta) & c_2\sin(-\alpha+\beta) \end{bmatrix} & (Sub = D) \end{cases} \tag{6}$$

$$\alpha = \frac{1}{2}\arccos(ICC(k)),$$

$$\beta = \arctan\left\{\tan(\alpha)\frac{c_2 - c_1}{c_2 + c_1}\right\}$$

$$c = 10^{\frac{CLD}{20}},$$

$$c_1(k) = \frac{\sqrt{c^2}}{\sqrt{1+c^2}},$$

$$c_2 = \frac{1}{\sqrt{1+c^2}}$$

The frequency-time conversion unit 28 converts the output signals which are frequency signals generated by the output signal generation unit 38 into time signals. Specifically, the frequency-time conversion unit 28 converts output signals represented by frequency signals L[k][n] into time signals L[n] using a complex QMF filter bank represented by Expression (7).

$$IQMF[k][n] = \frac{1}{64}\exp\left(j\frac{\pi}{128}\left(k+\frac{1}{2}\right)(2n-255)\right), \quad 0 \le k < 64,\ 0 \le n < 128 \tag{7}$$

Figure 15:
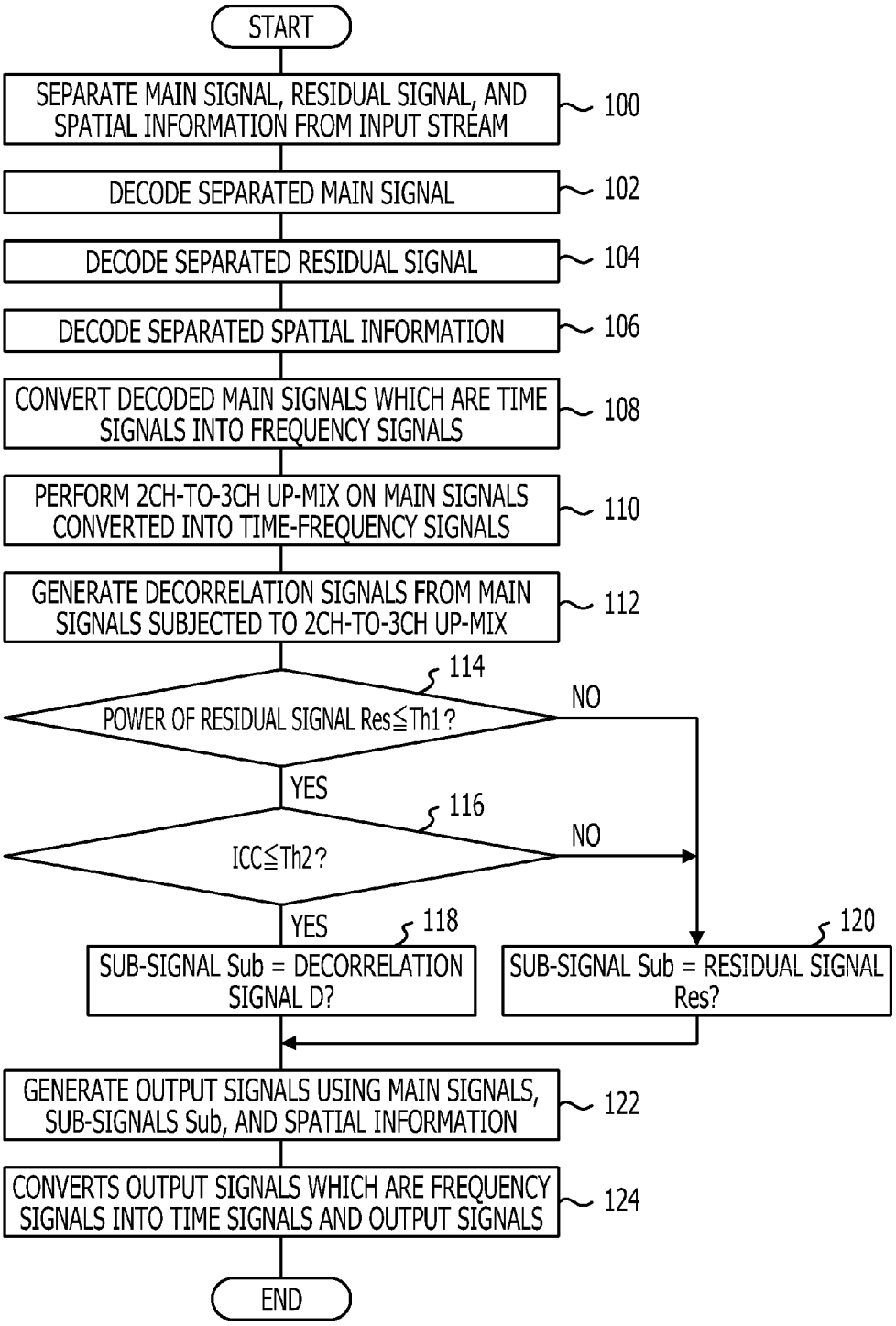
FIG. 15 is a flowchart illustrating a decoding process according to the first embodiment.

Next, the decoding process performed by the decoding device 10 according to the first embodiment will be described with reference to FIG. 15.

In step 100, the stream separation unit 12 separates an encoded main signal, an encoded residual signal, and an encoded spatial information from a multiplexed input stream. Subsequently, in step 102, the main signal decoder 14 decodes the encoded main signal which has been separated by the stream separation unit 12 so as to output main signals x1 and x2. Then, in step 104, the residual signal decoder 16 decodes the encoded residual signal which has been separated by the stream separation unit 12 so as to output a decoded residual signal Res. In step 106, the spatial information decoder 18 decodes the encoded spatial information which has been separated by the stream separation unit 12 so as to output decoded spatial information (CLD and ICC).

In step 108, the time-frequency conversion unit 22 converts the main signals x1 and x2 which are time signals decoded by the main signal decoder 14 into main signals X1 and X2 which are frequency signals. In step 110, the 2ch-to-3ch up-mix unit 24 performs up-mix on the main signals X1 and X2 which have been converted into the frequency signals by the time-frequency conversion unit 22 so as to output up-mix main signals In (Y1, Y2, and Y3) of three channels.

In step 112, the decorrelation signal generation unit 30 generates a decorrelation signal D as decorrelation of a main signal In. In step 114, the residual signal determination unit 32 determines whether a power of the residual signal Res is equal to or smaller than the threshold value Th1. When the power of the residual signal Res is equal to or smaller than the threshold value Th1, the process proceeds to step 16 whereas when the power of the residual signal Res is larger than the threshold value Th1, the process proceeds to step 120.

In step 116, the replacement target determination unit 34 determines whether the similarity ICC is equal to or smaller than the threshold value Th2. When the similarity ICC is equal to or smaller than the threshold value Th2, the process proceeds to step 118 whereas when the similarity ICC is larger than the threshold value Th2, the process proceeds to step 120.

In step 118, the sub-signal generation unit 36 generates a sub-signal Sub by replacing the residual signal Res by the decorrelation signal D and outputs the sub-signal Sub. On the other hand, in step 120, the sub-signal generation unit 36 outputs the residual signal Res as the sub-signal Sub.

In step 122, the output signal generation unit 38 generates output signals Out1 and Out2 of two channels from the main signal In, the sub-signal Sub output from the sub-signal generation unit 36, and the spatial information.

In step 124, the frequency-time conversion unit 28 converts the output signals Out1 and Out2 which are frequency signals generated by the output signal generation unit 38 into time signals and outputs the time signals as final decoded signals.

Figure 16:
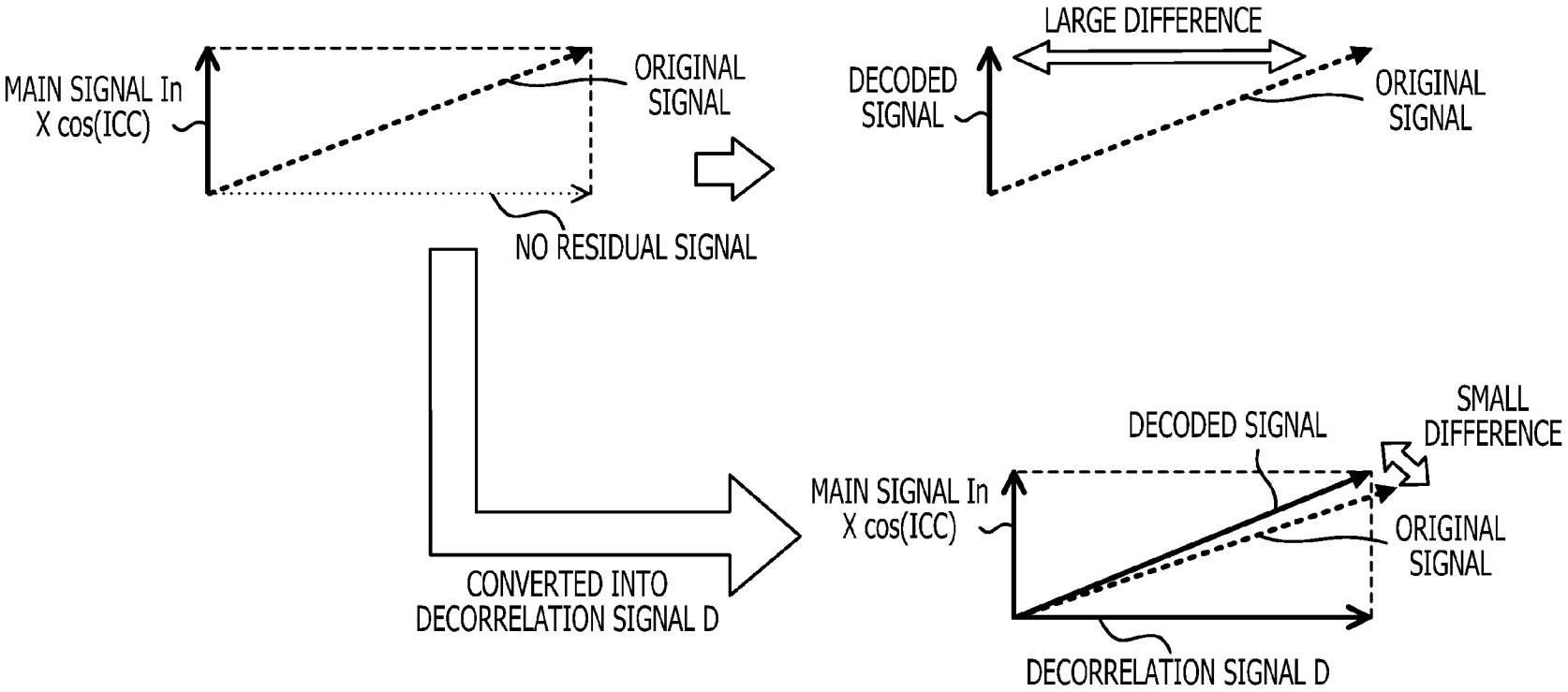
FIG. 16 is a diagram of vectors schematically illustrating effects of the first embodiment.
Figure 17:
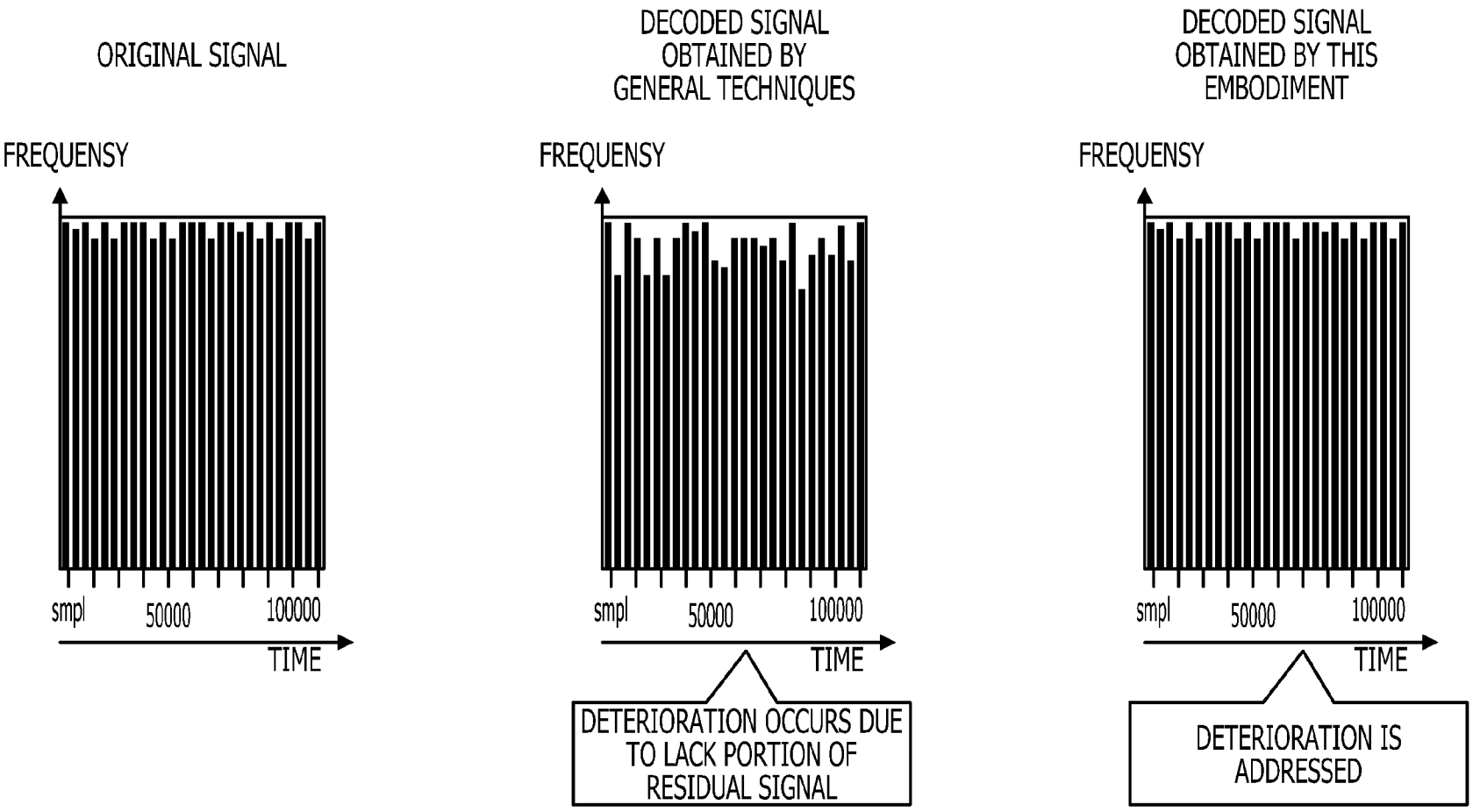
FIG. 17 is a diagram of spectra illustrating effects of the first embodiment.

FIG. 16 includes diagrams of vectors schematically illustrating effects of the decoding device 10 according to the first embodiment. When the residual signal Res includes a lack portion, differences between the original signals and the decoded signals are large. However, according to this embodiment, when the lack portion of the residual signal Res is replaced by the decorrelation signal D, differences between the original signals and the decoded signals are small. That is, deterioration of the decoded signals is suppressed. FIG. 17 is a diagram of spectra schematically illustrating effects of the decoding device 10 according to the first embodiment. In this embodiment, the deterioration of the decoded signals caused by the lack portion of the residual signal in the general techniques is addressed.

Next, a second embodiment will be described. A configuration of a decoding device according to the second embodiment is the same as that of the decoding device 10 according to the first embodiment except for an 1ch-to-2ch up-mix units, and therefore, only different points will be described.

Figure 18:
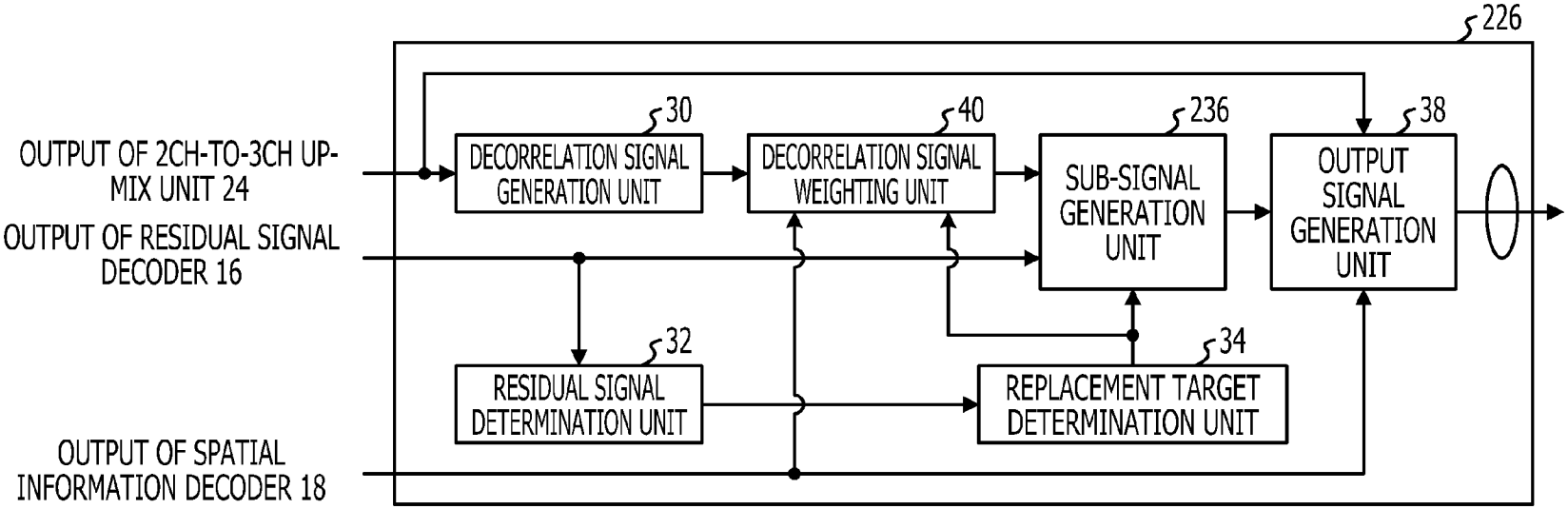
FIG. 18 is a functional block diagram illustrating an 1ch-to-2ch up-mix unit according to a second embodiment.

Each of 1ch-to-2ch up-mix units 226 of the second embodiment includes, as illustrated in FIG. 18, a decorrelation signal generation unit 30, a decorrelation signal weighting unit 40, a residual signal determination unit 32, a replacement target determination unit 34, a sub-signal generation unit 236, and an output signal generation unit 38.

Figure 19:
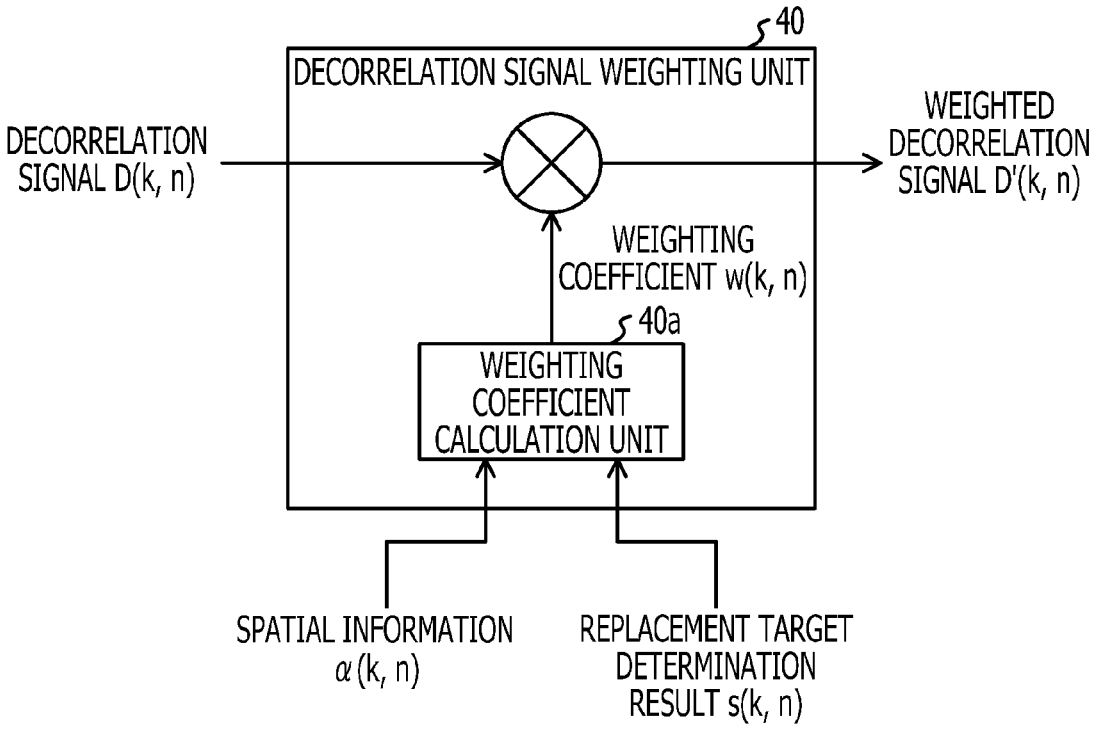
FIG. 19 is a functional block diagram illustrating decorrelation signal weighting unit according to the second embodiment.

The decorrelation signal weighting unit 40 calculates a weighting coefficient for a decorrelation signal D and outputs a weighted decorrelation signal D' which are obtained by weighting the decorrelation signal D by the weighting coefficient. A configuration of the decorrelation signal weighting unit 40 is illustrated in FIG. 19. A weighting coefficient calculation unit 40*a* calculates a weighting coefficient W(k, n) represented by Expression (8) below, for example.

$$W(k,n)=\begin{cases}1-\dfrac{|Res(k,n)|}{|D(k,n)\times\sin\alpha(k,n)|} & (s(k,n)=1)\\ 1 & (s(k,n)=0)\end{cases} \tag{8}$$

The example of Expression (8) represents that an amount of component of the decorrelation signal D included in the residual signal Res is removed from the decorrelation signal D by the weighting. In Expression (8), "α(k, n)" is a value obtained from the spatial information and is the same as "α" included in Expression (6). Furthermore, "s(k, n)" represents a result of a determination performed by the replacement target determination unit 34. When the value s(k, n) is equal to 1, a signal sample Res(k, n) of the residual signal Res is a replacement target. When the value s(k, n) is equal to 0, the signal sample Res(k, n) is not a replacement target.

Figure 20:
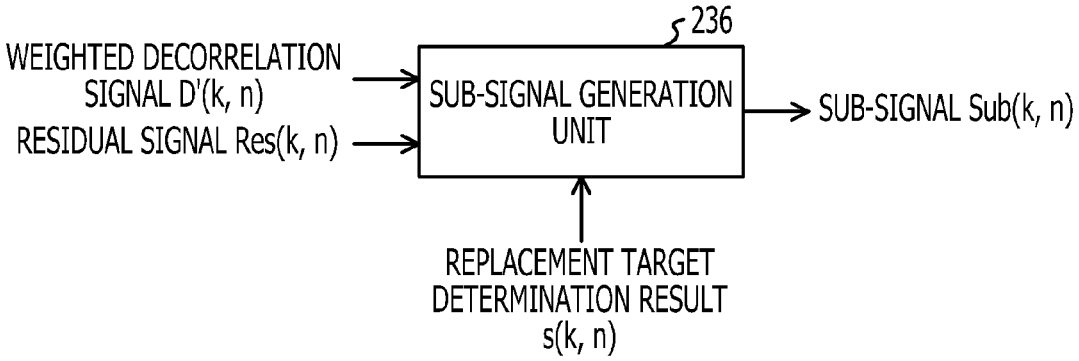
FIG. 20 is a functional block diagram illustrating a sub-signal generation unit according to the second embodiment.

The sub-signal generation unit 236 generates a sub-signal Sub using the weighted decorrelation signal D' generated by the decorrelation signal weighting unit 40 and the residual signal Res. A configuration of the sub-signal generation unit 236 is illustrated in FIG. 20. The sub-signal generation unit 236 generates the sub-signal Sub by adding the weighted decorrelation signal D' and the residual signal Res to each other as represented by Expression (9) below.

$$Sub(k,n)=\begin{cases}D'(k,n)+Res(k,n) & (s(k,n)=1)\\ Res(k,n) & (s(k,n)=0)\end{cases} \tag{9}$$

According to the decoding device of the second embodiment, deterioration of output signals may be suppressed when compared with the case where a lack portion of a decoded residual signal is simply replaced by a decorrelation signal.

Next, a third embodiment will be described. A configuration of a decoding device according to the third embodiment is the same as that of the decoding device according to the second embodiment except for a decorrelation signal weighting unit, and therefore, only different points will be described.

Figure 21:
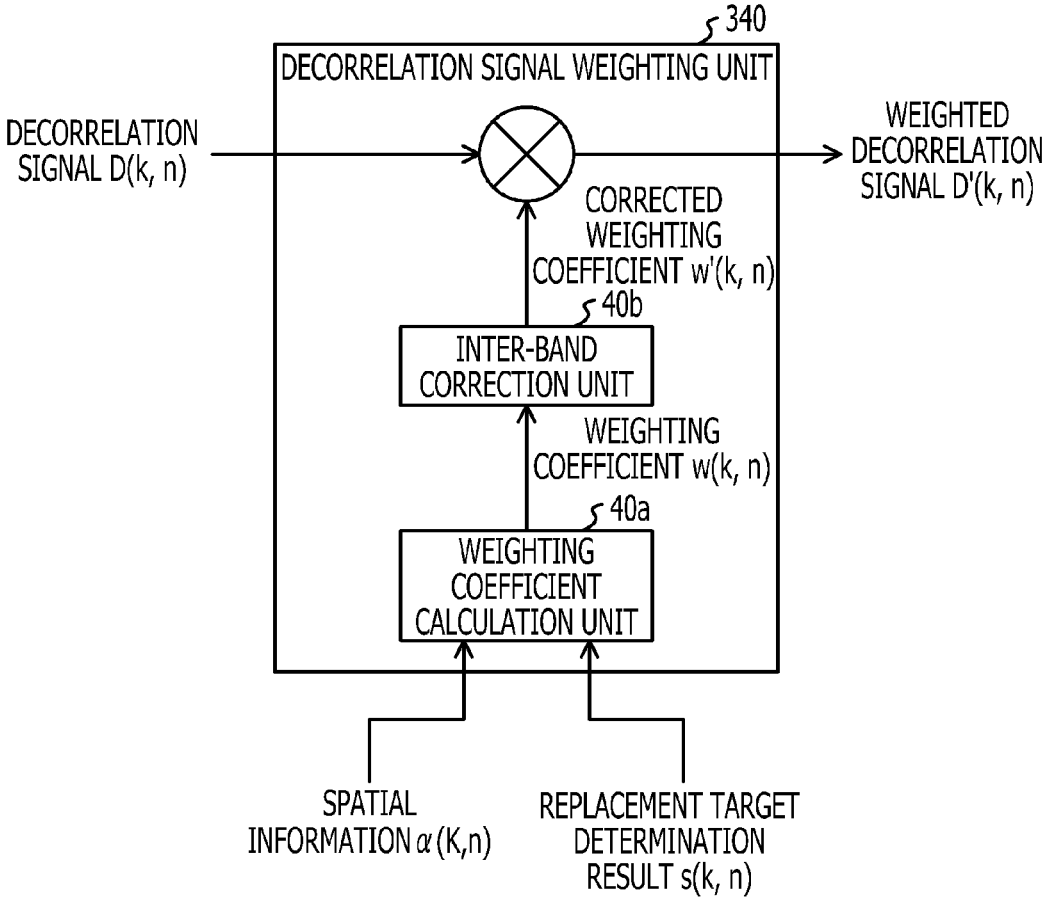
FIG. 21 is a functional block diagram illustrating decorrelation signal weighting unit according to a third embodiment.

A decorrelation signal weighting unit 340 calculates a weighting coefficient for a decorrelation signal D and outputs a decorrelation signal D' which is obtained by equalizing amounts of weighting of frequency bands and weighting the decorrelation signal D by the weighting coefficient. A configuration of the decorrelation signal weighting unit 340 is illustrated in FIG. 21. An inter-band correction unit 40*b* calculates a weighting coefficient W'(k, n) in which weighting is corrected as represented by Expression (10) below, for example.

$$W'(k,n)=x\times W(k,n)+(1-x)\times W(k-1,n) \tag{10}$$

Here, "x" denotes a coefficient and may be a fixed value such as 0.8. Furthermore, although a correction amount of a lower band k−1 relative to a target band k is fed back in Expression (10), an upper band k+1 or other bands may be used.

According to the decoding device of the third embodiment, when the weighting decorrelation signal is generated, the weighting amounts of bands are equalized as correction. Accordingly, deterioration of output signals caused by rapid change of weighting coefficients among the frequency bands may be reduced.

Next a fourth embodiment will be described. A configuration of a decoding device according to the fourth embodiment is the same as that of the decoding device 10 according to the first embodiment except for 1ch-to-2ch up-mix units, and therefore, only different points will be described.

Figure 22:
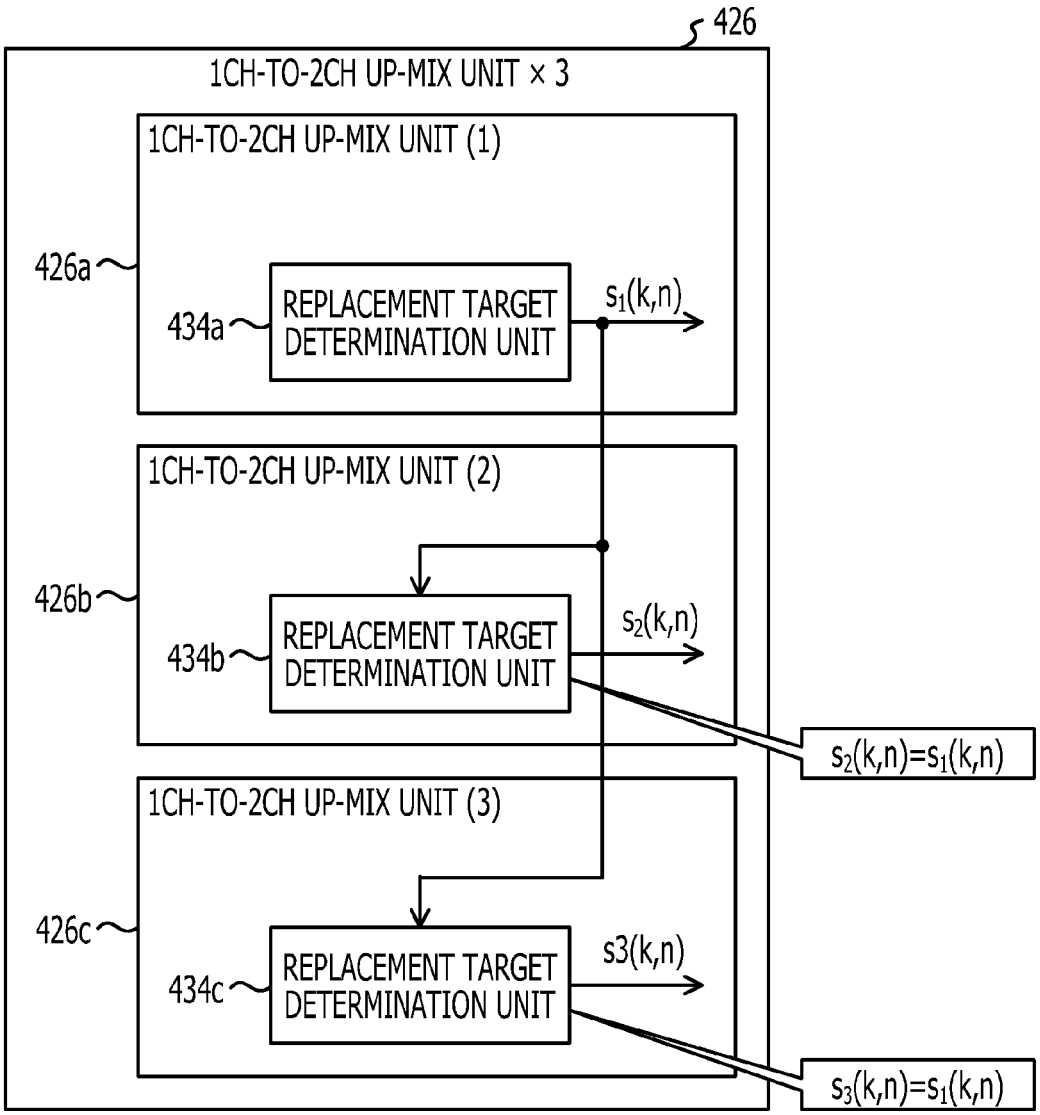
FIG. 22 is a functional block diagram illustrating an 1ch-to-2ch up-mix unit according to a fourth embodiment.

As illustrated in FIG. 22, each of 1ch-to-2ch up-mix units 426 includes three 1ch-to-2ch up-mix units 426*a* to 426*c* corresponding to three channels obtained by performing up-mix using a 2ch-to-3ch up-mix unit 24. Each of the 1ch-to-2ch up-mix units 426*a*, 426*b*, and 426*c* has a configuration the same as that of the 1ch-to-2ch up-mix units 26 of the first embodiment illustrated in FIG. 2.

The 1ch-to-2ch up-mix unit 426 outputs results of determinations performed by replacement target determination units 434*b* and 434*c* included in the 1ch-to-2ch up-mix units 426*b* and 426*c* using a result of a determination performed by a replacement target determination unit 434*a* of the 1ch-to-2ch up-mix units 426*a*. For example, it is assumed that the results of the determinations performed by the replacement target determination units 434*a*, 434*b*, and 434*c* are denoted by $s_1(k, n)$, $s_2(k, n)$, and $s_3(k, n)$, respectively. The replacement target determination units 434*b* and 434*c* copy and output the result of the determination performed by the replacement target determination unit 434*a* in accordance with Expressions (11) and (12).

$$s_2(k,n)=s_1(k,n) \tag{11}$$

$$s_3(k,n)=s_1(k,n) \tag{12}$$

According to the decoding device of the fourth embodiment, a calculation amount may be reduced when compared with a case where results of determinations of replacement target determination units are individually obtained.

Note that, although the case where a determination result of a residual signal determination unit and a determination result of a replacement target determination unit are used is described in the foregoing embodiments, a determination as to whether a residual signal is to be replaced by a decorrelation signal may be performed only using the determination result of the residual signal determination unit.

Furthermore, although the case where the decoding program 58 is stored (installed) in the nonvolatile storage unit 46 is described in the foregoing description, the present technique is not limited to this. For example, the decoding program of the disclosed technique may be provided in a state in which the decoding program is recorded in a recording medium such as a CD-ROM or a DVD-ROM.

Furthermore, the decoding device of the disclosed technique may be configured by hardware which realizes the processes of the various units.

All the documents, all the patent applications, and all the technical standards cited in this specification are incorporated herein by reference to the degree of a case where a fact that the individual documents, the individual patent applications, and the individual technical standards are incorporated by reference is particularly and individually described.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A decoding device comprising:

a decoder configured to separate a first signal obtained by performing down-mix on original signals of a plurality of channels, a residual signal representing a component of a difference between the original signals and the first signal, and spatial information representing the relationship among the original signals of the plurality of channels from an input signal which is obtained by multiplexing the first signal, the residual signal, and the spatial information and decode the separated encoded first signal, the encoded residual signal, and the encoded spatial information;

a decorrelation signal generation unit configured to generate a decorrelation signal as decorrelation of the first signal decoded by the decoder;

a residual signal determination unit configured to determine whether a level of the residual signal decoded by the decoder is equal to or smaller than a predetermined residual threshold value;

a second-signal generation unit configured to generate a second signal corresponding to the decoded residual signal when the residual signal determination unit determines that the level of the residual signal is larger than the residual threshold value whereas generate a second signal by replacing the decoded residual signal by the decorrelation signal generated by the decorrelation signal generation unit when the residual signal determination unit determines that the level of the residual signal is equal to or smaller than the residual threshold value; and an output signal generation unit configured to generate an output signal by decoding the input signal in accordance with the first signal decoded by the decoder, the second signal generated by the second signal generation unit, and the spatial information decoded by the decoder.

2. The decoding device according to claim 1, further comprising:

a replacement target determination unit configured to determine that the decoded residual signal corresponding to the decoded spatial information is a replacement target when a similarity degree among the original signals of the plurality of channels represented by the relationship represented by the spatial information decoded by the decoder is equal to or smaller than a predetermined similarity threshold value, wherein the second-signal generation unit generates a second signal corresponding to a signal obtained by replacing the residual signal by the decorrelation signal when the residual signal determination unit determines that the level of the residual signal is equal to or smaller than the residual threshold value and the replacement target determination unit determines that the residual signal is a replacement target.

3. The decoding device according to claim 1, wherein the second-signal generation unit generates a second signal by adding the decorrelation signal which is weighted in accordance with a level of the decoded residual signal and the decoded residual signal to each other.

4. The decoding device according to claim 3, wherein the second-signal generation unit equalizes, when the decoded first signal is divided into a plurality of frequency bands, weights of the frequency bands.

5. The decoding device according to claim 2, wherein, when the first signals of a plurality of channels are used, the decoding device includes a plurality of the replacement target determination units corresponding to the different channels and one of results of determinations performed by the replacement target determination units is used as the other results of the determinations performed by the other replacement target determination units.

6. A decoding method comprising:

separating a first signal obtained by performing down-mix on original signals of a plurality of channels, a residual signal representing a component of a difference between the original signals and the first signal, and spatial information representing the relationship among the original signals of the plurality of channels from an input signal which is obtained by multiplexing the first signal, the residual signal, and the spatial information and decoding the separated encoded first signal, the encoded residual signal, and the encoded spatial information;

generating a decorrelation signal, by a computer processor, as decorrelation of the first signal decoded by the decoding;

determining using the residual signal whether a level of the residual signal decoded by the decoding is equal to or smaller than a predetermined residual threshold value;

generating a second signal corresponding to the decoded residual signal when the determining using the residual signal determines that the level of the residual signal is larger than the residual threshold value whereas generate a second signal by replacing the decoded residual signal by the decorrelation signal generated by the generating of the decorrelation signal when the determining using the residual signal determines that the level of the residual signal is equal to or smaller than the residual threshold value; and generating an output signal by decoding the input signal in accordance with the first signal decoded by the decoding, the second signal generated by the generating of the second signal, and the spatial information decoded by the decoding.

7. The decoding method according to claim 6, further comprising:

determining that the decoded residual signal corresponding to the decoded spatial information is a replacement target when a similarity degree among the original signals of the plurality of channels represented by the relationship represented by the spatial information decoded by the decoding is equal to or smaller than a predetermined similarity threshold value, wherein, in the generating of the second signal, a second signal corresponding to a signal obtained by replacing the residual signal by the decorrelation signal is generated when the level of the residual signal is determined to be equal to or smaller than the residual threshold value in the determining using the residual signal and the residual signal is determined to be a replacement target in the determining of the replacement target.

8. The decoding method according to claim 6, wherein, in the generating of the second signal, a second signal is generated by adding the decorrelation signal which is weighted in accordance with a level of the decoded residual signal and the decoded residual signal to each other.

9. The decoding method according to claim 7, wherein, in the generating of the second signal, when the decoded first signal is divided into a plurality of frequency bands, weights of the frequency bands are equalized.

10. The decoding method according to claim 7, wherein, when the first signals of a plurality of channels are used, the decoding method includes a plurality of determining of a replacement target corresponding to the different channels and one of results of the determining of a replacement target is used as the other results of the determinations of a replacement target.

11. A non-transitory computer-readable storage medium storing a decoding program that causing a computer to execute a process comprising:

separating a first signal obtained by performing down-mix on original signals of a plurality of channels, a residual signal representing a component of a difference between the original signals and the first signal, and spatial information representing the relationship among the original signals of the plurality of channels from an input signal which is obtained by multiplexing the first signal, the residual signal, and the spatial information and decoding the separated encoded first signal, the encoded residual signal, and the encoded spatial information;

generating a decorrelation signal as decorrelation of the first signal decoded by the decoding;

determining using the residual signal whether a level of the residual signal decoded by the decoding is equal to or smaller than a predetermined residual threshold value;

generating a second signal corresponding to the decoded residual signal when the determining using the residual signal determines that the level of the residual signal is larger than the residual threshold value whereas generate a second signal by replacing the decoded residual signal by the decorrelation signal generated by the generating of the decorrelation signal when the determination using the residual signal determines that the level of the residual signal is equal to or smaller than the residual threshold value; and generating an output signal by decoding the input signal in accordance with the first signal decoded by the decoding, the second signal generated by the generating of the second signal, and the spatial information decoded by the decoding.

12. The non-transitory computer-readable storage medium according to claim 11, further comprising:

determining that the decoded residual signal corresponding to the decoded spatial information is a replacement target when a similarity degree among the original signals of the plurality of channels represented by the relationship represented by the spatial information decoded by the decoding is equal to or smaller than a predetermined similarity threshold value, wherein, in the generating of the second signal, a second signal corresponding to a signal obtained by replacing the residual signal by the decorrelation signal is generated when the level of the residual signal is determined to be equal to or smaller than the residual threshold value in the determining using the residual signal and the residual signal is determined to be a replacement target in the determining of the replacement target.

13. The non-transitory computer-readable storage medium according to claim 11, wherein, in the generating of the second signal, a second signal is generated by adding the decorrelation signal which is weighted in accordance with a level of the decoded residual signal and the decoded residual signal to each other.

14. The non-transitory computer-readable storage medium according to claim 12, wherein, in the generating of the second signal, when the decoded first signal is divided into a plurality of frequency bands, weights of the frequency bands are equalized.

15. The non-transitory computer-readable storage medium according to claim 12, wherein, when the first signals of a plurality of channels are used, the decoding method includes a plurality of determining of a replacement target corresponding to the different channels and one of results of the determining of a replacement target is used as the other results of the determinations of a replacement target.

16. A decoding device comprising:

a processor; and a memory which stores a plurality of instructions, which when executed by the processor, cause the processor to execute, separating a first signal obtained by performing down-mix on original signals of a plurality of channels, a residual signal representing a component of a difference between the original signals and the first signal, and spatial information representing the relationship among the original signals of the plurality of channels from an input signal which is obtained by multiplexing the first signal, the residual signal, and the spatial information and decoding the separated encoded first signal, the encoded residual signal, and the encoded spatial information;

generating a decorrelation signal as decorrelation of the first signal decoded by the decoding;

determining using the residual signal whether a level of the residual signal decoded by the decoding is equal to or smaller than a predetermined residual threshold value;

generating a second signal corresponding to the decoded residual signal when the determining using the residual signal determines that the level of the residual signal is larger than the residual threshold value whereas generate a second signal by replacing the decoded residual signal by the decorrelation signal generated by the generating of the decorrelation signal when the determining using the residual signal determines that the level of the residual signal is equal to or smaller than the residual threshold value; and generating an output signal by decoding the input signal in accordance with the first signal decoded by the decoding, the second signal generated by the generating of the second signal, and the spatial information decoded by the decoding.

* * * * *